US006279833B1

(12) United States Patent
Schwiede

(10) Patent No.: US 6,279,833 B1
(45) Date of Patent: Aug. 28, 2001

(54) GUIDE-RAIL ATTACHMENT FOR RAILROAD SWITCH

(75) Inventor: Karl-Heinz Schwiede, Kreuzlingen (CH)

(73) Assignee: Schwihag Gesellschaft fur Eisenbahnoberbau mbH, Tagerwilen (CH)

( * ) Notice: Subject to any disclaimer, the term of this patent is extended or adjusted under 35 U.S.C. 154(b) by 0 days.

(21) Appl. No.: 09/399,265

(22) Filed: Sep. 17, 1999

(30) Foreign Application Priority Data

Sep. 18, 1998 (DE) ..... 198 42 929

(51) Int. Cl.[7] ..... E01B 5/00
(52) U.S. Cl. ..... 238/17
(58) Field of Search ..... 238/17, 20, 21; 246/415 R

(56) References Cited

U.S. PATENT DOCUMENTS 1,939,560 * 12/1933 Maney ..... 238/17
4,265,401 * 5/1981 Jackson ..... 238/17
5,148,980 * 9/1992 Fritz et al. ..... 237/17
5,176,318 1/1993 Young .
5,238,186 * 8/1993 Young et al. ..... 238/17

FOREIGN PATENT DOCUMENTS 513 291 A 9/1971 (CH) .
0 725 184 A 8/1996 (EP) .

* cited by examiner

*Primary Examiner*—Mark T. Le
(74) *Attorney, Agent, or Firm*—Herbert Dubno

(57) ABSTRACT

A guide-rail assembly has an anchor plate having an upstanding flange with a transversely directed face and formed below the face with at least one transversely throughgoing hole and a guide rail above the hole and having a transversely directed outer face bearing transversely on the flange face and an inner face directed transversely oppositely. A J-bolt has a bearing face directed transversely toward and bearing on the guide-rail inner face and a shank extending through the hole below the guide rail. A nut threaded on the shank and engaging an outer surface of the plate presses the J-bolt bearing face against the guide-rail inner face and clamps the guide rail against the anchor-plate face.

15 Claims, 5 Drawing Sheets

GUIDE-RAIL ATTACHMENT FOR RAILROAD SWITCH

FIELD OF THE INVENTION

The present invention relates to a railroad switch. More particularly this invention concerns an attachment for the guard rail of such a switch.

BACKGROUND OF THE INVENTION

A check or guard rail is provided extending parallel to a running rail at a sharp curve or railroad switch to prevent a rail-car wheel from slipping sideways off the running rail. In particular they are used at the frog of a rail system with a UIC 33 or U69 profile. Such guard rails are secured to guide-rail anchor plates and must extend parallel to and at an exact spacing from the running rail. They are subject to considerable wear.

As a rule such a guide rail is through-bolted to the guide-rail anchor plate. To this end the anchor plates must be installed on the sleepers at an exact spacing so that their holes correspond exactly to the holes in the preformed guide rails. Obviously installing the anchor plates this precisely in the field is fairly difficult and often requires that the anchor plates be removed and reinstalled, greatly slowing the installation process.

It is also known to simply drill the anchor plates and/or the guide rail at the site to ensure that their holes align perfectly. Such a procedure is also fairly cumbersome and difficult to carry out in the field. This is particularly disadvantageous when guide rails are being replaced, as the rail stretch must be taken out of service for a considerable time while the new guide rails are fitted, drilled, and mounted.

OBJECTS OF THE INVENTION

It is therefore an object of the present invention to provide an improved attachment system for a railroad-switch guide rail.

Another object is the provision of such an improved attachment system for a railroad-switch guide rail which over-comes the above-given disadvantages, that is which is relatively simple in that it eliminates the hole-alignment problems of the prior art.

SUMMARY OF THE INVENTION

A guide-rail assembly has according to the invention an anchor plate having an upstanding flange with a transversely directed face and formed below the face with at least one transversely throughgoing hole and a guide rail above the hole and having a transversely directed outer face bearing transversely on the flange face and an inner face directed transversely oppositely. In accordance with the invention a J-bolt has a bearing face directed transversely toward and bearing on the guide-rail inner face and a shank extending through the hole below the guide rail. A nut threaded on the shank and engaging an outer surface of the plate presses the J-bolt bearing face against the guide-rail inner face and clamps the guide rail against the anchor-plate face.

Thus with this system there is no need for accurately formed and positioned holes in the guide rail and anchor plate(s). Instead the guide rail can be made free of holes, which makes it stronger and less expensive to manufacture, while it still can be clamped solidly to the anchor plates which need merely be placed at no more than a certain minimum spacing. The installation and replacement of such a guide rail is an extremely simple job. The hole(s) in the anchor plate can be formed in the factory, so that no drilling at the site is required.

Thus with such a system the guard rail is installed, after the anchor plate has been bolted to the sleeper at the appropriate spacing from the running rail, simply by dropping it into place and then tightening the J-bolts. Shims can be used between the J-bolt and anchor-plate flange to finely adjust the spacing between the guard rail and the running rail. Similarly the J-bolts can be loosened in an existing installation and shims inserted to compensate for wear.

In accordance with the invention the hole and shank are centered on a common axis and the plate and J-bolt are formed with complementary generally planar surfaces extending generally parallel to the axis and engaging one another so that rotation of the J-bolt about the axis is inhibited by engagement of the planar surfaces. More particularly the plate planar surface is formed in the hole and the J-bolt planar surface is formed on the shank. In this case the plate planar surface is directed downward and the J-bolt planar surface is directed upward. Alternately or in addition the plate planar surface is directed upward immediately adjacent the hole and the J-bolt planar surface is directed downward immediately adjacent the shank. It is also possible for the plate to be formed adjacent the hole with at least one upstanding ridge having a vertical surface constituting the plate planar surface. In this case the bolt has a side face constituting the J-bolt planar surface. Normally the plate has two such upstanding ridges having confronting vertical surfaces closely flanking the J-bolt. Thus the nut, which is normally a lock nut, can be torqued down without having to put a wrench on the J-bolt, since its rotation is effectively inhibited by the anchor plate which itself is solidly bolted to the sleeper.

The guide rail according to the invention is generally U-section and has a pair of vertically spaced flanges. The J-bolt bearing face has a vertical dimension equal generally to a vertical spacing between the guide-rail flanges. This construction ensures proper vertical positioning of the guide rail relative to the sleeper to which the anchor plate and running rail are attached.

For best grip of the J-bolt on the guide rail the J-bolt bearing face has a textured surface. In addition the J-bolt bearing face carries a compressible bumper and/or the anchor-plate face carries a similar compressible bumper. When both have such bumpers they are of similar compressibility.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
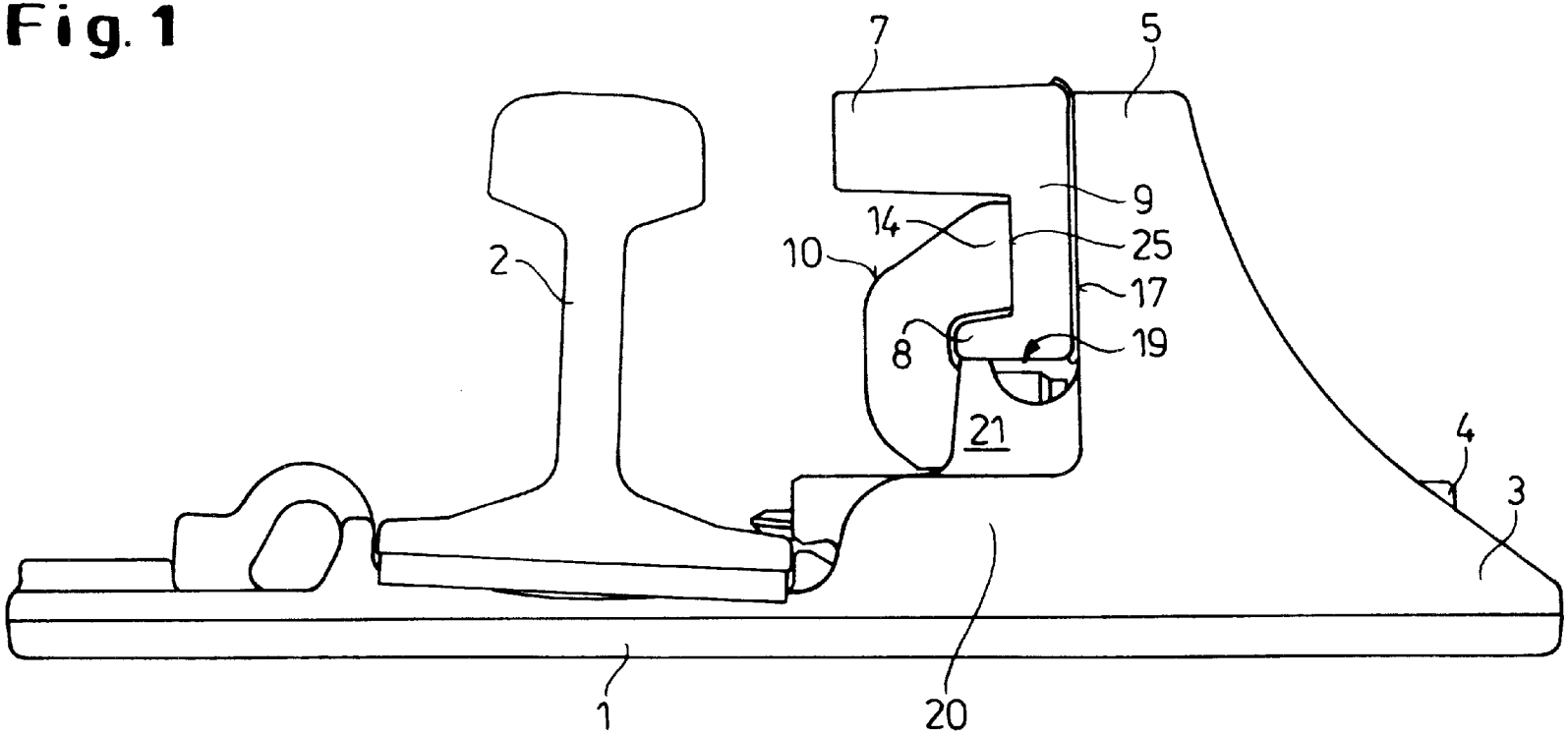
FIG. 1 is an end view of the guide rail of this invention.
Figure 2:
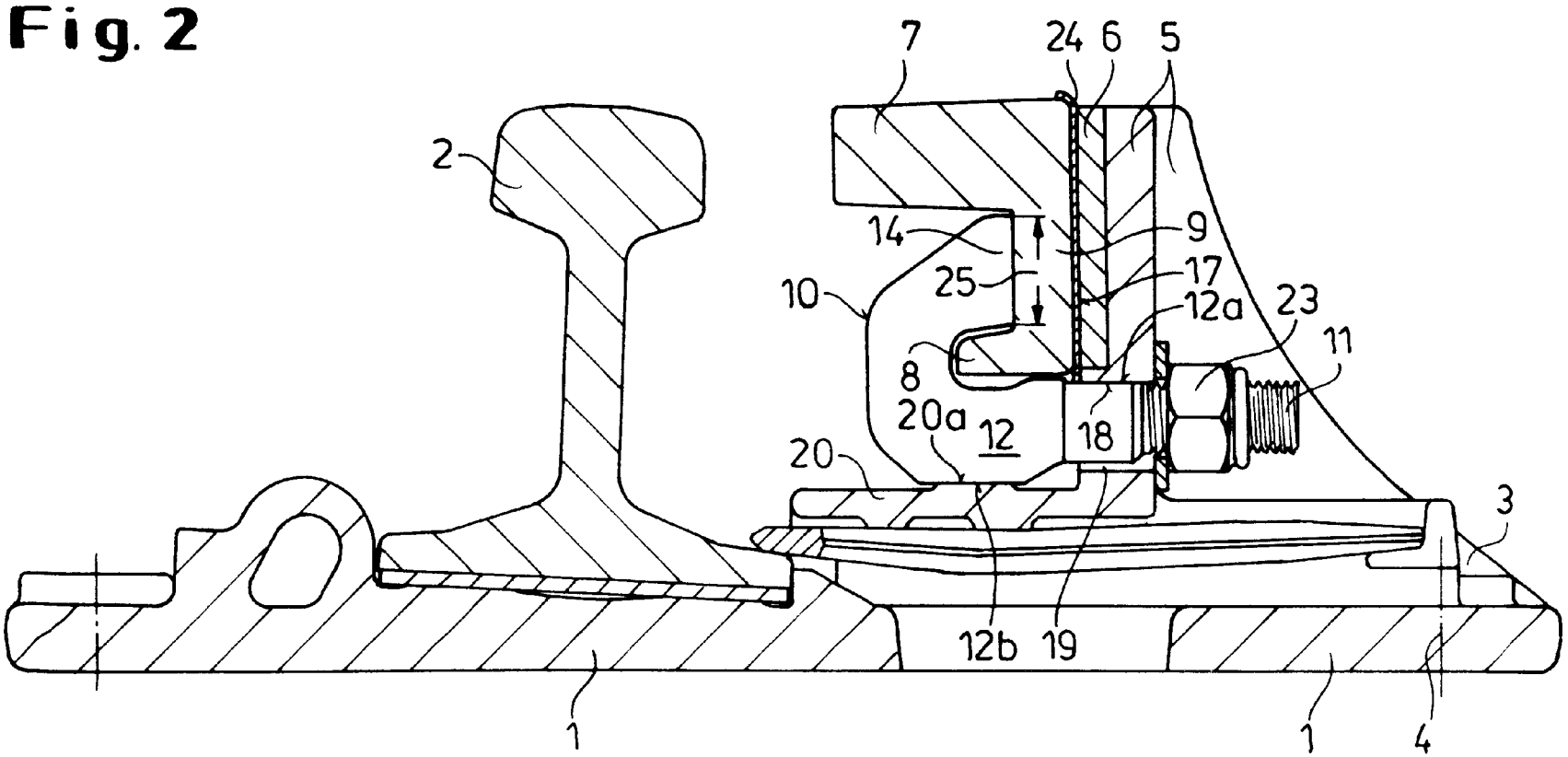
FIG. 2 is a cross section through the guide rail.
Figure 3:
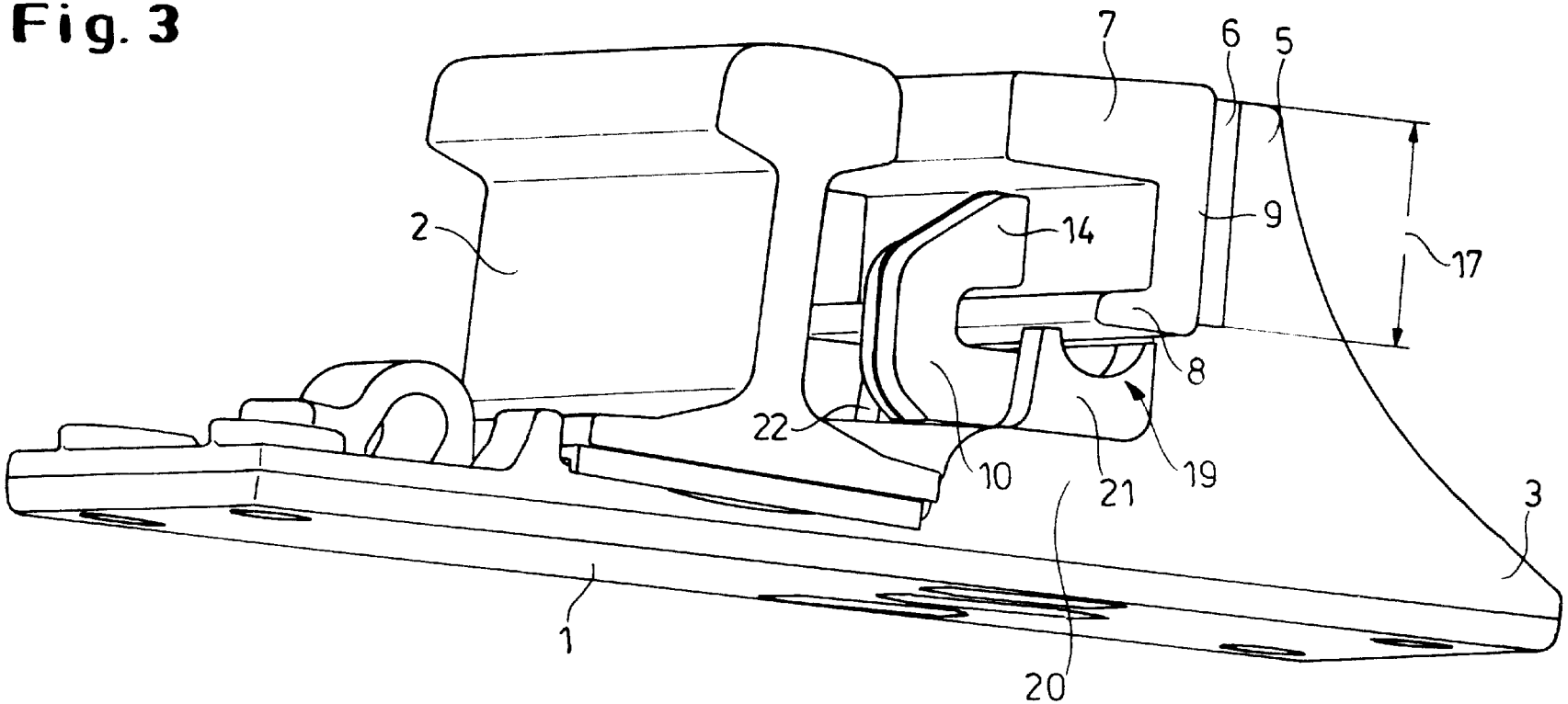
FIG. 3 is a perspective view of the guide rail.

As seen in FIGS. 1 to 3, a sleeper 1 carries a standard running rail 2 and a guide-rail anchor plate 3, the latter secured in place by bolts 4. The plate 3 has an upstanding flange 5 carrying an elastomeric bumper 6 against which a guide rail 9 having a pair of flanges 7 and 8 is secured by J-bolts 10. The upper flange 7 of the rail 9 is substantially longer than the lower flange 8 and is level with the head of the rail 2.

Figure 4:
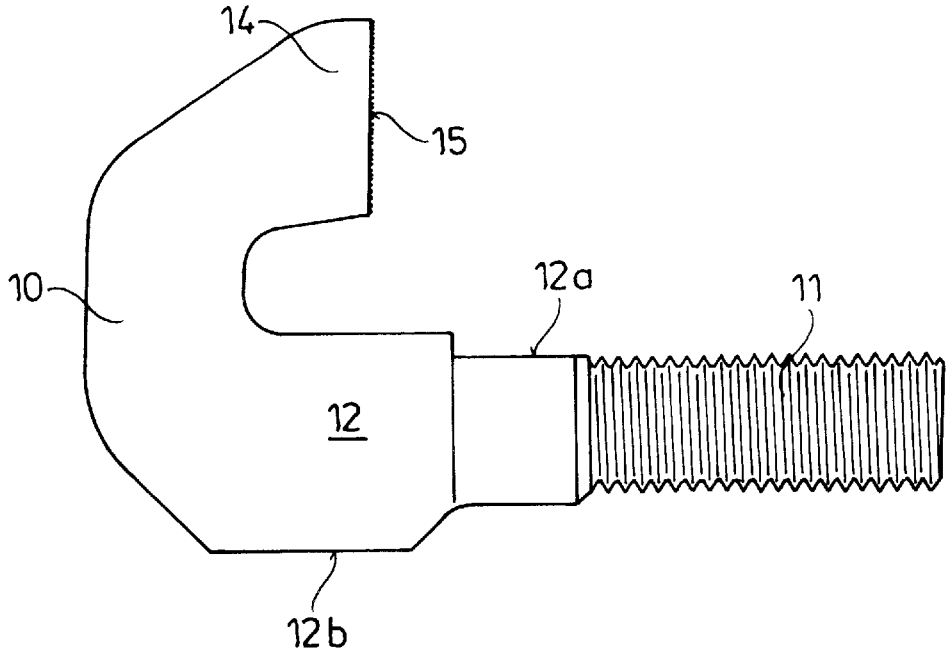
FIG. 4 is a side view of the retaining bolt.
Figure 5:
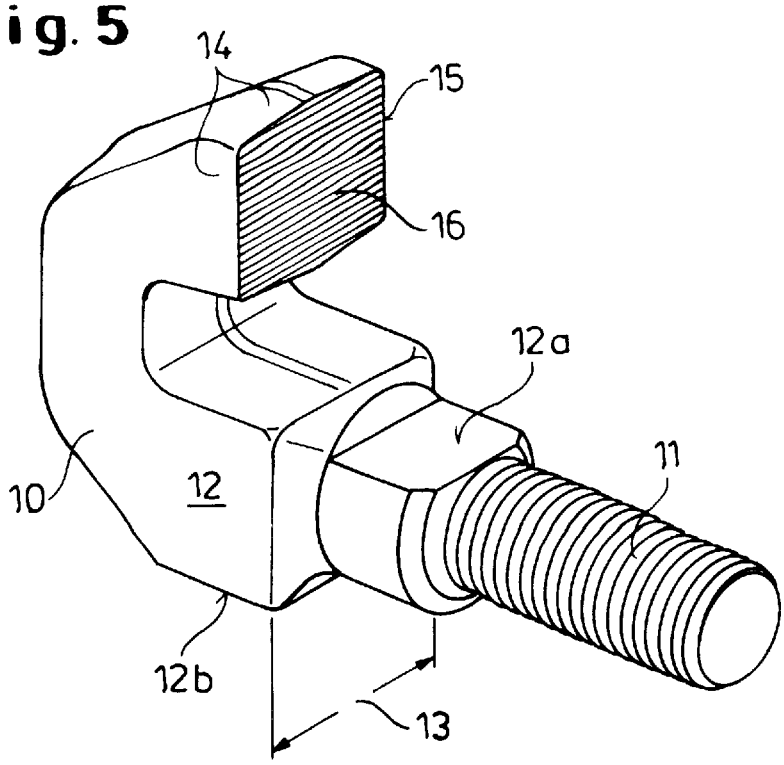
FIG. 5 is a perspective view of the retaining bolt.
Figure 6:
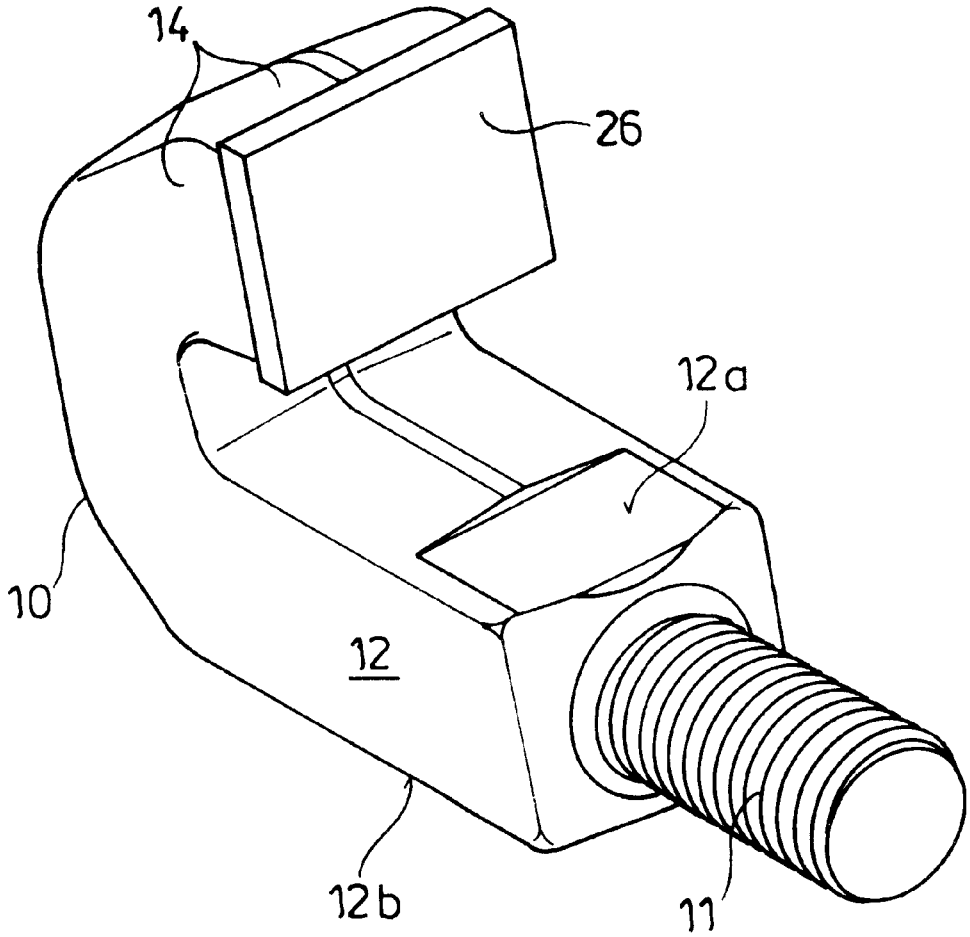
FIG. 6 is perspective view of a variant on the retaining bolt.

Each J-bolt 10 has as shown in FIGS. 4 and 5 a long threaded shank 11 and a body formed with an upper facet or flat 12*a* adjacent the threaded shank 11 and a lower facet or flat 12*b*. The upper flat 12*a* has a length 13 measured parallel to the axis of the shank 11 sufficient for a standard wrench to be fitted to it. To each side of the lower flat 12*b* the bolt 10 has a pair of planar and parallel side faces or flats 12 extending perpendicular to the flats 12*a* and 12*b*. The bolt 10 has an end 14 provided with a bearing face 15 that presses against the bight of the rail 9 and that can have facial formations such as milling 16 for a better grip or be provided as shown in FIG. 6 with an elastomeric bumper sheet 26. The face 15 has a vertical height 25 which is roughly equal to the vertical space between the flanges 7 and 9.

The anchor plate 3 is formed with a hole 18 through which the shank 11 fits and that is shaped in an outer region 19 so as to fit complementarily with the facet 12*a*. In addition underneath each such hole 18 the plate 3 has a formation 20 with an upper surface 20*a* fitting complementarily with the lower flat 12*b*, and is formed to each side of this surface 20*a* with upstanding flanges 21 and 22 that embrace and guide the bolt 10, fitting against its side faces 12. In face these flanges or ridges 21 and 22 can be used to support the guide rail 9 by bearing agianst the lower face of its lower flange 8.

To assemble this system the bolts 10 are at first fitted to the holes 18 and lock nuts 23 are screwed a few turns onto the outer ends of the shanks 11. The bolts 10 are not fully pushed into the holes 18 so there is sufficient spacing between the bearing surface 15 of the bolt 10 and a bearing surface 17 of the bumper 6 on the flange 5 that the lower flange 8 of the rail 9 can be dropped down between these faces 15 and 17. Once the rail 7 is in position the nuts 23 are tightened. Due to the complementary fit between the flats 12, 12*a*, and 12*b* and the surrounding planar faces of the structures 19, 20*a*, 21, and 22, the bolts 10 will not turn as the nuts 23 are torqued home. If necessary shims 24 can be inserted between the faces 15 and 17 during installation or subsequently to compensate for wear.

I claim:

1. A guide-rail assembly comprising:

an anchor plate having an upstanding flange with a transversely directed face and formed below the face with at least one transversely throughgoing hole;

a guide rail above the hole and having a transversely directed outer face bearing transversely on the flange face and an inner face directed transversely oppositely;

a J-bolt having a bearing face directed transversely toward and bearing on the guide-rail inner face and a shank extending through the hole below the guide rail; and a nut threaded on the shank, engaging an outer surface of the plate, pressing the J-bolt bearing face against the guide-rail inner face, and clamping the guide rail against the anchor-plate face, the hole and shank being centered on a common axis, the plate and J-bolt being formed with complementary generally planar surfaces extending generally parallel to the axis and engaging one another, whereby rotation of the J-bolt about the axis is inhibited by engagement of the planar surfaces, the plate planar surface being formed in the hole and the J-bolt planar surface being formed on the shank, the plate planar surface being directed downward and the J-bolt planar surface being directed upward.

2. The guide-rail assembly defined in claim 1 wherein the plate is formed adjacent the hole with at least one upstanding ridge having a vertical surface constituting a further planar surface, the bolt having a side face constituting a further J-bolt planar surface.

3. The guide-rail assembly defined in claim 2 wherein the plate has two such upstanding ridges having confronting vertical surfaces closely flanking the J-bolt.

4. The guide-rail assembly defined in claim 1 wherein the guide rail is generally U-section and has a pair of vertically spaced flanges, the J-bolt bearing face having a vertical dimension equal generally to a vertical spacing between the guide-rail flanges.

5. The guide-rail assembly defined in claim 1 wherein the J-bolt bearing face has a textured surface.

6. The guide-rail assembly defined in claim wherein the J-bolt bearing face carries a compressible bumper.

7. The guide-rail assembly defined in claim 1 wherein the J-bolt bearing face and anchor-plate face carry respective compressible bumpers of similar compressibility.

8. A guide-rail assembly comprising:

an anchor plate having an upstanding flange with a transversely directed face and formed below the face with at least one transversely throughgoing hole;

a guide rail above the hole and having a transversely directed outer face bearing transversely on the flange face and an inner face directed transversely oppositely;

a J-bolt having a bearing face directed transversely toward and bearing on the guide-rail inner face and a shank extending through the hole below the guide rail; and a nut threaded on the shank, engaging an outer surface of the plate, pressing the J-bolt bearing face against the guide-rail inner face, the anchor-plate face carrying a compressible bumper, the anchor-plate bumper being recessed in the anchor-plate face.

9. The guide-rail assembly defined in claim 8 wherein the hole and shank are centered on a common axis and the plate and J-bolt are formed with complementary generally planar surfaces extending generally parallel to the axis and engaging one another, whereby rotation of the J-bolt about the axis is inhibited by engagement of the planar surfaces.

10. The guide-rail assembly defined in claim 9 wherein the plate planar surface is formed in the hole and the J-bolt planar surface is formed on the shank.

11. The guide-rail assembly defined in claim 10 wherein the plate planar surface is directed downward and the J-bolt planar surface is directed upward.

12. The guide-rail assembly defined in claim 9 wherein the plate is formed adjacent the hole with at least one upstanding ridge having a vertical surface constituting the plate planar surface, the bolt having a side face constituting the J-bolt planar surface.

13. The guide-rail assembly defined in claim 12 wherein the plate has two such upstanding ridges having confronting vertical surfaces closely flanking the J-bolt.

14. The guide-rail assembly defined in claim 9 wherein the guide rail is generally U-section and has a pair of vertically spaced flanges, the J-bolt bearing face having a vertical dimension equal generally to a vertical spacing between the guide-rail flanges.

15. The guide-rail assembly defined in claim 9 wherein the J-bolt bearing face has a textured surface.

* * * * *